US011339949B1

(12) United States Patent
Rabin et al.

(10) Patent No.: US 11,339,949 B1
(45) Date of Patent: May 24, 2022

(54) DOWNLIGHT LUMINAIRE BAFFLES AND BAFFLE COMPONENTS

(71) Applicant: ABL IP Holding LLC, Atlanta, GA (US)

(72) Inventors: Andrew E. Rabin, Morton Grove, IL (US); Darcie Callison, Palatine, IL (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/152,333

(22) Filed: Jan. 19, 2021

(51) Int. Cl.

| | |
|---|---|
| ***F21V 11/02*** | (2006.01) |
| ***F21V 21/03*** | (2006.01) |
| ***F21S 8/02*** | (2006.01) |
| ***F21V 17/16*** | (2006.01) |
| ***F21V 21/04*** | (2006.01) |
| ***F21V 17/00*** | (2006.01) |
| ***F21V 7/04*** | (2006.01) |

(52) U.S. Cl.
CPC ..... *F21V 11/02* (2013.01); *F21S 8/026* (2013.01); *F21V 17/16* (2013.01); *F21V 21/03* (2013.01); *F21S 8/02* (2013.01); *F21V 7/048* (2013.01); *F21V 17/007* (2013.01); *F21V 21/04* (2013.01); *F21V 21/041* (2013.01); *F21V 21/042* (2013.01); *F21V 21/043* (2013.01); *F21V 21/044* (2013.01); *F21V 21/045* (2013.01); *F21V 21/046* (2013.01); *F21V 21/047* (2013.01); *F21V 21/048* (2013.01); *F21V 21/049* (2013.01)

(58) Field of Classification Search
CPC ..... F21V 21/04; F21V 21/041; F21V 21/042; F21V 21/043; F21V 21/044; F21V 21/045; F21V 21/046; F21V 21/047; F21V 21/048; F21V 21/049; F21V 7/048; F21V 17/007; F21S 8/02; F21S 8/026
See application file for complete search history.

(56) References Cited

U.S. PATENT DOCUMENTS

| | | | | |
|---|---|---|---|---|
| D158,240 | S | 4/1950 | Wood | |
| 3,040,172 | A * | 6/1962 | Chan | F21S 8/02 362/257 |
| 3,182,187 | A | 5/1965 | Gellert | |
| 3,381,123 | A | 4/1968 | Docimo | |

(Continued)

*Primary Examiner* — Alexander K Garlen
*Assistant Examiner* — Colin J Cattanach
(74) *Attorney, Agent, or Firm* — Kilpatrick Townsend & Stockton LLP

(57) ABSTRACT

A baffle component for a luminaire includes a portion of opaque material that forms a front surface and a back surface as major surfaces. The front surface includes multiple ridges. The material also includes a top surface and a bottom surface, and a first end surface and a second end surface. The first end surface includes a first coupling feature, and the second end surface includes a second coupling feature that is configured to engage the first coupling feature of a second baffle component that is substantially identical to the baffle component. A baffle for a luminaire includes a plurality of such components. The baffle components engage with one another, with the first coupling feature of each of the baffle components engaging with the second coupling feature of another of the baffle components, to form a shape that surrounds a central opening of the luminaire.

16 Claims, 6 Drawing Sheets

(56) References Cited

U.S. PATENT DOCUMENTS 3,518,420 A * 6/1970 Kripp ..... F21V 21/04 362/257
D291,253 S 8/1987 Ortega
4,729,075 A 3/1988 Brass
4,729,080 A * 3/1988 Fremont ..... F21V 21/04 362/148
5,452,193 A 9/1995 Hinnefeld et al.
5,548,499 A 8/1996 Zadeh
D386,802 S 11/1997 Kim
D423,732 S 4/2000 McGee
D427,368 S 6/2000 Kelmelis et al.
D437,074 S 1/2001 Johnson
6,217,189 B1 * 4/2001 Nassim ..... F21S 8/02 362/147
6,464,378 B1 * 10/2002 Reed ..... F21V 7/10 362/297
D469,212 S 1/2003 Chiu
6,588,922 B1 * 7/2003 DeCicco ..... F21V 21/04 362/148
6,779,908 B1 8/2004 Ng
D501,269 S 1/2005 Parres
D506,849 S 6/2005 Parres
D533,959 S 12/2006 Wambaugh et al.
D569,024 S 5/2008 Redfern
D578,237 S 10/2008 Engel
7,431,482 B1 10/2008 Morgan et al.
D589,207 S 3/2009 Fujiwara et al.
D599,951 S 9/2009 Pickard et al.
D601,295 S 9/2009 Brown
7,597,460 B1 10/2009 Rashidi
7,722,208 B1 * 5/2010 Dupre ..... F21S 8/02 362/147
D625,875 S 10/2010 Chen et al.
D627,913 S 11/2010 Gielen
D633,636 S 3/2011 Gielen
D636,118 S 4/2011 Kim et al.
D653,799 S 2/2012 Baker et al.
8,134,300 B2 3/2012 Maglica et al.
8,215,805 B2 7/2012 Cogliano et al.
8,511,867 B1 * 8/2013 Tam ..... E04F 13/06 362/366
D689,649 S 9/2013 Popper et al.
D691,321 S 10/2013 Chen et al.
D693,517 S 11/2013 Davis
D696,447 S 12/2013 Huh
D698,971 S 2/2014 Guzzini
D699,880 S 2/2014 Szoke
D700,737 S 3/2014 Campagna
D707,877 S 6/2014 Turner
D713,595 S 9/2014 Lechtenberg et al.
D718,004 S 11/2014 Stovall
D725,818 S 3/2015 Yao et al.
8,979,329 B1 * 3/2015 Moore ..... F21V 7/10 362/346
9,028,104 B2 5/2015 Lee et al.
D738,032 S 9/2015 Maxik et al.
D740,996 S 10/2015 Tragatschnig
D741,539 S 10/2015 Gettings et al.
D742,583 S 11/2015 Gettings et al.
D743,094 S 11/2015 Gettings et al.
D745,210 S 12/2015 Serwacki et al.
D750,315 S 2/2016 Yao et al.
D751,246 S 3/2016 Yao et al.
D759,873 S 6/2016 Saaranen et al.
D766,497 S 9/2016 Salomon
D766,797 S 9/2016 Li
D767,808 S 9/2016 Lehman
D773,109 S 11/2016 Hu
D779,101 S 2/2017 Redfern
D785,852 S 5/2017 Rashidi Doust
D787,106 S 5/2017 Tai
D788,968 S 6/2017 Salomon
D789,586 S 6/2017 Guzzini
D789,597 S 6/2017 Wallach
D802,819 S 11/2017 Czech et al.
D824,566 S 7/2018 Santoro et al.
D827,912 S 9/2018 Momin
D827,914 S 9/2018 Momin
D829,367 S 9/2018 Momin
D831,873 S 10/2018 Rybol et al.
D833,062 S 11/2018 Pincente et al.
D851,326 S 6/2019 Tepo et al.
D859,732 S 9/2019 Robinson
10,415,775 B2 9/2019 Tepo et al.
D877,401 S 3/2020 Tepo et al.
10,670,206 B2 6/2020 Tepo et al.
10,900,625 B2 1/2021 Tepo et al.
2007/0268707 A1 * 11/2007 Smester ..... F21V 29/773 362/362
2009/0273938 A1 * 11/2009 Wronski ..... F21V 15/01 362/346
2012/0134162 A1 * 5/2012 Hanacek ..... F21S 8/026 362/364
2012/0287648 A1 * 11/2012 Stauner ..... F21V 21/03 362/317
2013/0051034 A1 2/2013 Hashimoto
2014/0104844 A1 * 4/2014 Fereydouny ..... F21V 17/14 362/293
2014/0175979 A1 * 6/2014 Rea ..... F21V 25/00 315/85
2018/0172260 A1 6/2018 Simonyi et al.
2018/0266662 A1 * 9/2018 Yifan ..... F21V 15/013
2018/0320843 A1 11/2018 Tepo et al.
2019/0170309 A1 * 6/2019 Zeng ..... F21V 7/00
2020/0256543 A1 * 8/2020 Stange ..... F21V 17/002

* cited by examiner

DOWNLIGHT LUMINAIRE BAFFLES AND BAFFLE COMPONENTS

BACKGROUND

Interior lighting luminaires (e.g., light fixtures) are often designed for aesthetic appeal when directly viewed, as well as for providing high quality illumination. To meet these objectives, ceiling-mounted downlight luminaires often include a housing that is mounted in and above the ceiling, and about flush with the ceiling surface; a light engine within the housing; and a baffle that extends between the light engine and the lower edge of the housing. The baffle is sometimes designed to provide visual interest as well as obscuring parts of the luminaire that would otherwise be viewable between the light engine and the lower edge of the housing. The baffle may also be used to limit the spread of light, for example to shield viewers from high-angle light output (glare).

SUMMARY

In various embodiments herein, downlight baffles are formed of manufacturable components that fit together to form shapes that may be square or rectangular, or may form any other polygonal shape, for use in downlighting or for other lighting applications.

In one or more embodiments, a baffle component for a luminaire includes a portion of opaque material that forms a front surface and a back surface as major surfaces. The front surface includes multiple ridges. The portion of opaque material also includes a top surface and a bottom surface that each extend from the front surface to the back surface, and a first end surface and a second end surface, that each extend from the front surface to the back surface, and from the top surface to the bottom surface. The first end surface includes a first coupling feature, and the second end surface includes a second coupling feature that is configured to engage the first coupling feature of a second baffle component that is substantially identical to the baffle component.

In one or more embodiments, a baffle for a luminaire includes multiple, substantially similar baffle components. Each such baffle component includes a portion of opaque material that forms a front surface and a back surface as major surfaces. The front surface includes multiple ridges. The portion of opaque material also includes a top surface and a bottom surface that each extend from the front surface to the back surface, and a first end surface and a second end surface, that each extend from the front surface to the back surface, and from the top surface to the bottom surface. The first end surface includes a first coupling feature, and the second end surface includes a second coupling feature that is configured to engage the first coupling feature of another one of the baffle components. The baffle components engage with one another, with the first coupling feature of each of the baffle components engaging with the second coupling feature of another of the baffle components, to form a shape that surrounds a central opening of the luminaire, an optical axis being defined as a centerline of the central opening. At least a portion of light emitted into the central opening can pass unobstructed from any point within or above the baffle, through the central opening, and can exit below the bottom surfaces.

BRIEF DESCRIPTION OF THE DRAWINGS

Embodiments are described in detail below with reference to the following figures, in which like numerals within the drawings and mentioned herein represent substantially identical structural elements.

DETAILED DESCRIPTION

Figure 1:
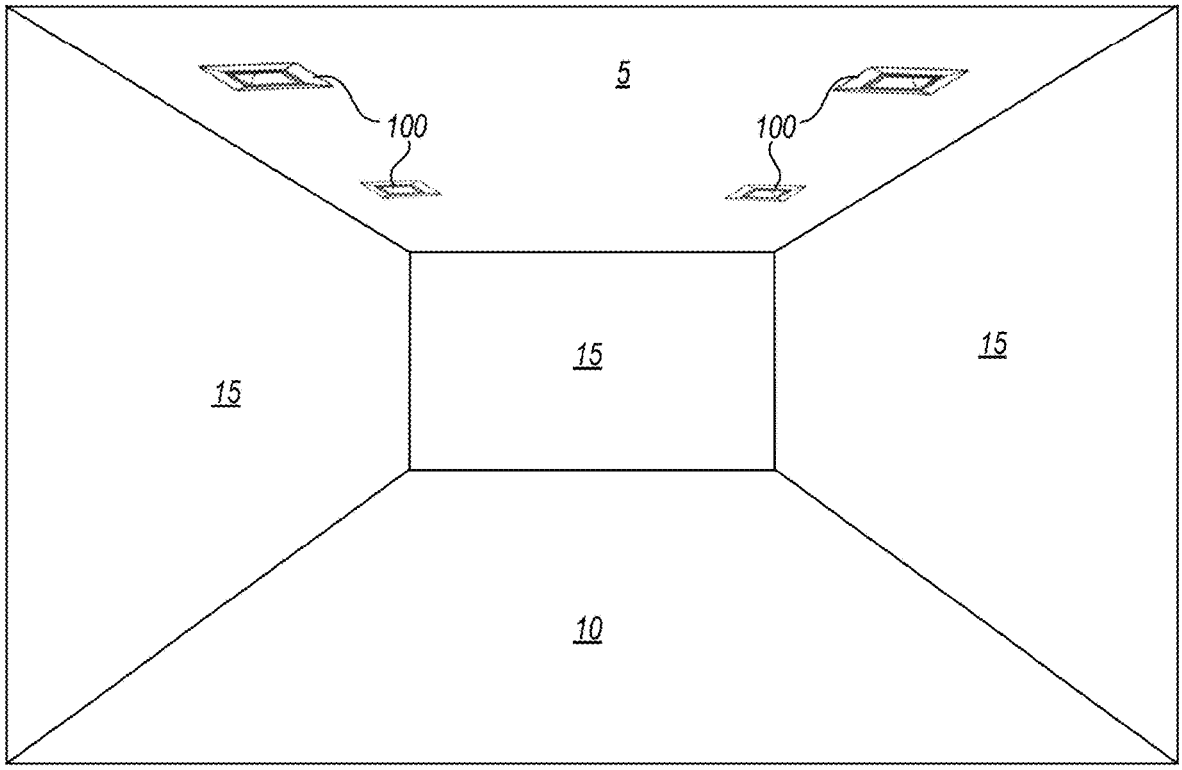
FIG. 1 schematically illustrates an interior space partially bounded by walls, a floor and a ceiling, with four square downlights mounted therein, in accord with one or more embodiments.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on another embodiment to yield a further embodiment. Upon reading and comprehending the present disclosure, one of ordinary skill in the art will readily conceive many variations, equivalents, extensions, and alternatives to the specific, disclosed luminaires and luminaire components, all of which are within the scope of embodiments herein.

In the following description, positional terms like "above," "below," "vertical," "horizontal" and the like are sometimes used to aid in understanding features shown in the drawings as presented, that is, in the orientation in which labels of the drawings read normally. These meanings are adhered to, notwithstanding that luminaires herein may be manufactured in any orientation, and/or mounted to surfaces that are not horizontal.

A common configuration for downlight luminaires includes a recessed can-type housing, a round light engine and a round baffle. The baffle is often provided with ridges for visual interest and light scattering. Deep ridges are often considered visually desirable. When round baffles with deep ridges are formed by molding, a typical approach is to configure the ridges in a spiral configuration, so that the inner part of the mold can be unscrewed from the molded part after the molded baffle hardens. Otherwise, a simple, two piece mold cannot be used because deep circular ridges interfere with removal of the inner part of the mold. That is, the ridges themselves interfere with the features of the mold when attempting to remove the baffle from the mold. For similar reasons, it is not possible to mold a square baffle with deep ridges at all with a simple two part mold. Even if the ridges were to be designed as a spiral, the corners of the square, molded part make it impossible to unscrew an inner part of the mold. Sometimes baffles in square trims are formed in progressive steps for moldability, but these steps create large shadows and do not define crisp edges like deep ridges do. The finish provided by progressive steps may be considered aesthetically unappealing, and baffles with such steps may not reduce glare as well as deep ridges would.

Thus, square or rectangular luminaires that emit light downwardly (sometimes simply called "downlights" herein) that are simultaneously attractive and inexpensive are relatively uncommon at present due to the molding issues noted above. Some square or rectangular downlights that are presently commercially available are believed to use more costly techniques than molding, such as machining or bending, to produce ridged baffles.

Downlight baffles, components thereof, and related systems and methods of manufacturing are disclosed according to various embodiments. Certain embodiments provide square or rectangular downlight baffles that can be used in downlight luminaires having corresponding square or rectangular form factors. The present technology can also be extended to create baffles of other form factors, as described below.

FIG. 1 schematically illustrates an interior space partially bounded by walls 15, a floor 10 and a ceiling 5, with four square downlight luminaires 100 mounted therein. Details of luminaires 100, such as ridges within the light-emitting portions of luminaires 100, are not distinguishable at the scale of FIG. 1.

Figure 2A:
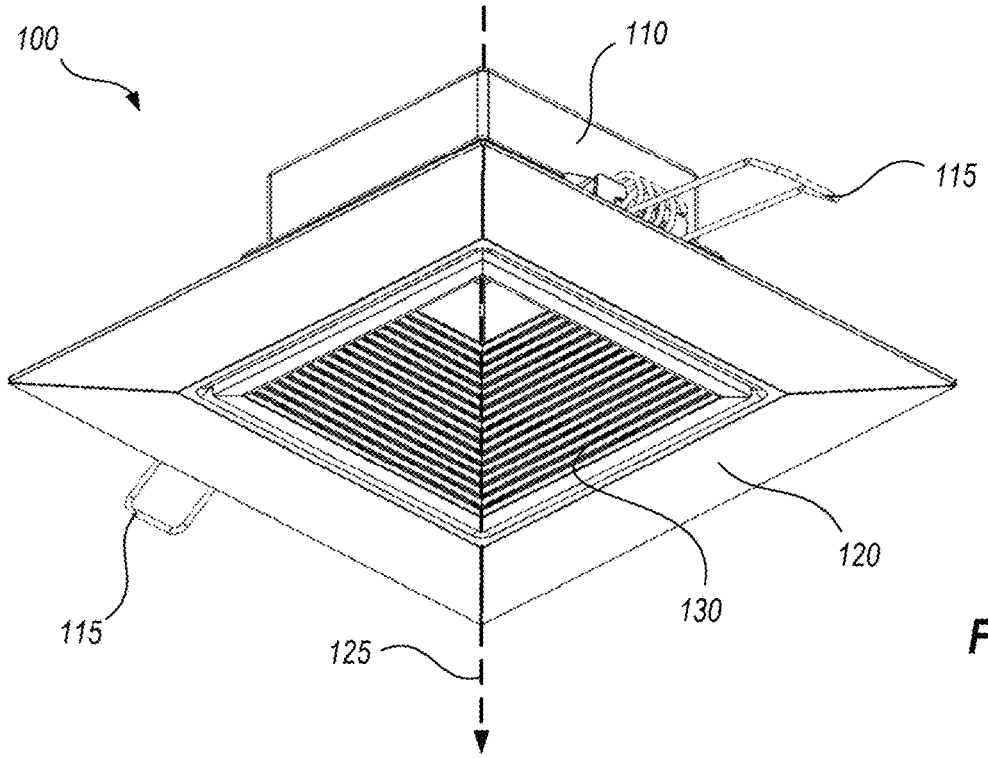
FIG. 2A is a schematic, upward looking perspective view of an exemplary downlight luminaire, that illustrates certain mechanical features of the downlight in accord with one or more embodiments.
Figure 2B:
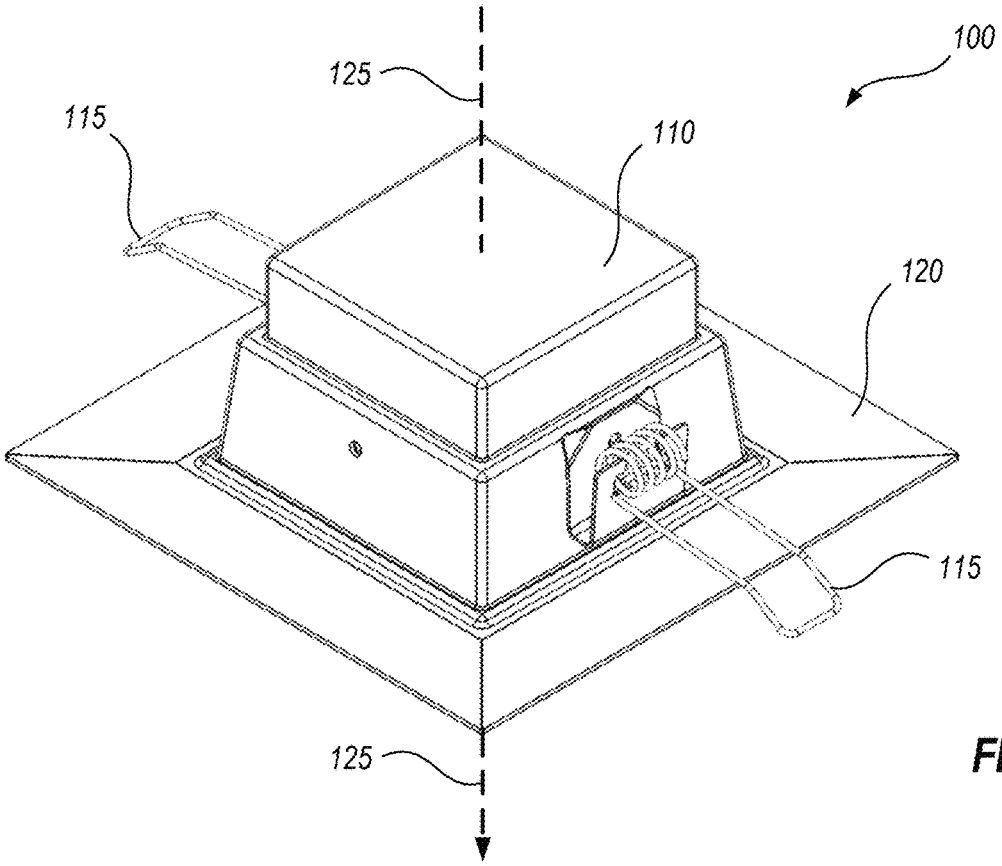
FIG. 2B is a schematic, downward looking perspective view of the exemplary downlight luminaire of FIG. 2A.
Figure 2C:
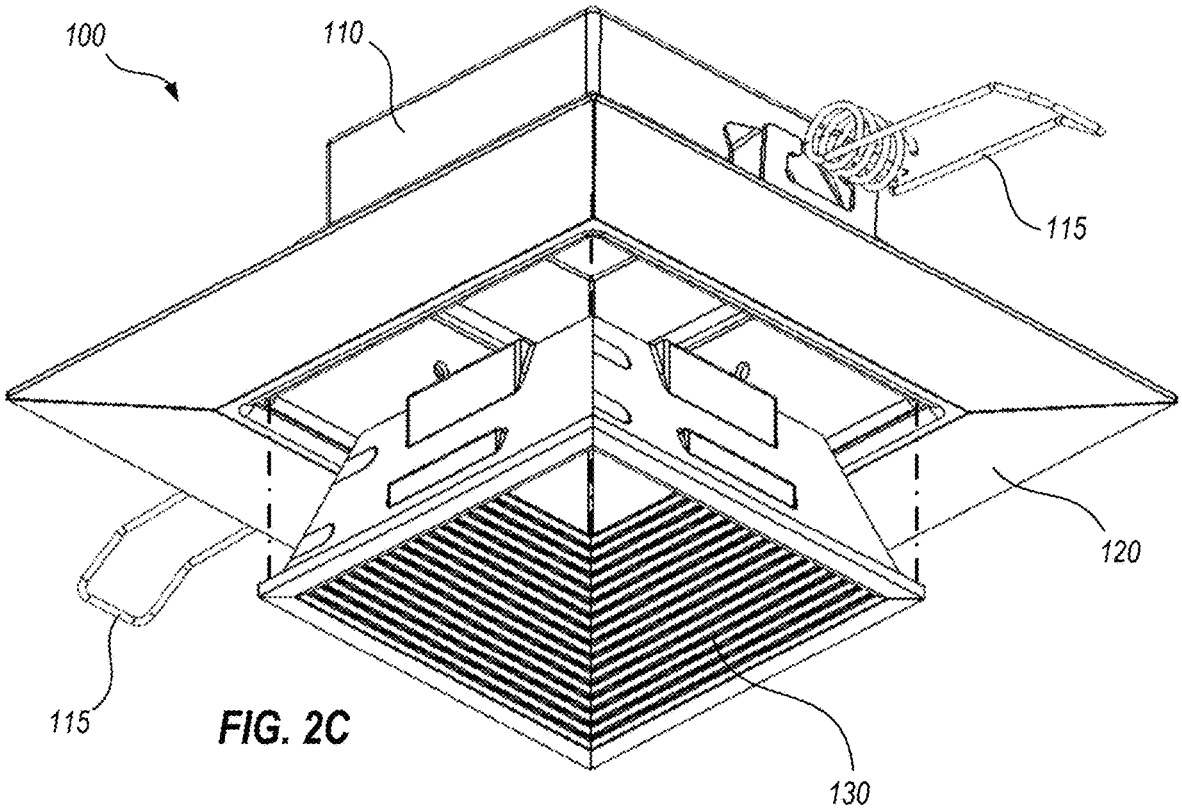
FIG. 2C is a schematic, exploded view of the exemplary downlight luminaire of FIG. 2A.

FIG. 2A is a schematic, upward looking perspective view, FIG. 2B is a schematic, downward looking perspective view, and FIG. 2C is a schematic, exploded view, that illustrate certain mechanical features of an exemplary downlight luminaire 100. Electrical components of luminaire 100 are not shown, for clarity of illustration. Exemplary luminaire 100 is square in plan view, but this is not required. Luminaire 100 includes a housing 110, a trim ring 120, a baffle 130 (not visible in FIG. 2B) and mounting fixtures 115. Mounting fixtures 115 may be, for example, springs that an installer can fold up in tension against sides of housing 110 to prepare for installation. The installer may insert an upper surface of housing 110, and mounting fixtures 115, into an aperture formed in a mounting surface (e.g., a piece of drywall or ceiling tile). Then, the installer can release mounting fixtures 115 so that they apply a downward force atop the mounting surface, pulling luminaire 100 into place with trim ring 120 abutting a lower side of the mounting surface. Trim ring 120 can thus hide any rough edges of the aperture, and/or any gaps between edges of the aperture and housing 110. An optical axis 125 is also illustrated in FIGS. 2A and 2B; because exemplary luminaire 100 is square, optical axis 125 is a centerline of luminaire 100 in either horizontal direction. A light source will typically be mounted within luminaire 100, and centered on optical axis 125; the light source may be mounted above, about the same height as, or below the top of baffle 130. Interior surfaces of baffle 130 face optical axis 125.

Figure 3:
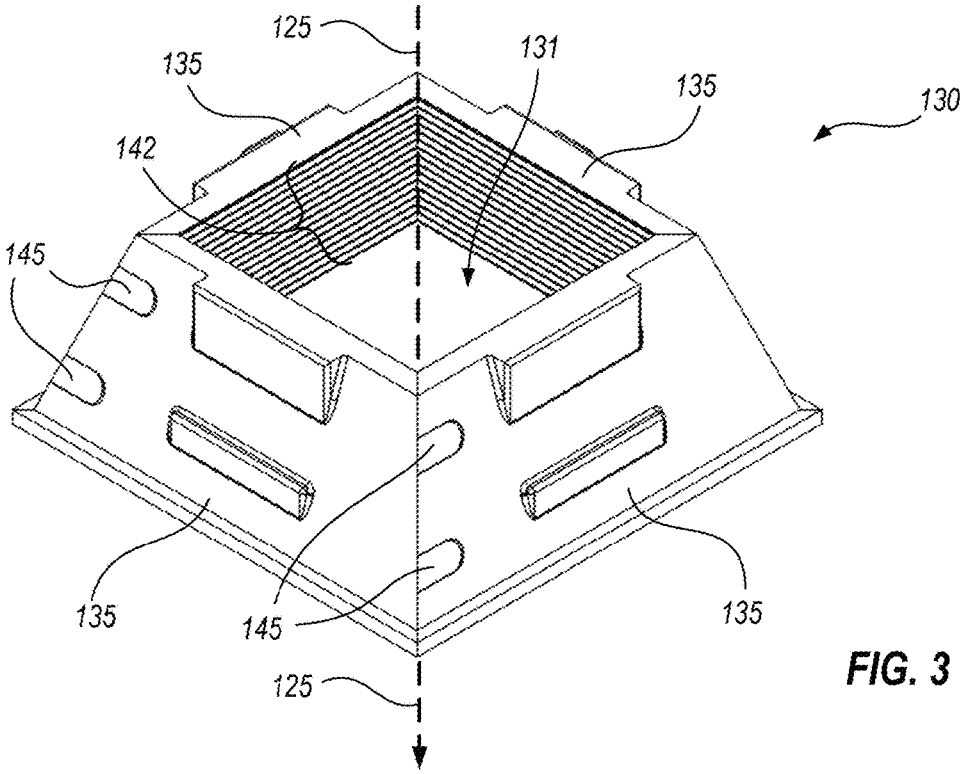
FIG. 3 is a downward looking perspective view of the exemplary baffle shown in FIGS. 2A through 2C, in accord with one or more embodiments.

FIG. 3 is a downward looking perspective view of exemplary baffle 130. FIG. 3 shows that baffle 130 includes four exemplary baffle components 135, each of which forms a side of baffle 130. Each baffle component 135 is typically made of an opaque material, and is either formed of a light colored material or is coated (e.g., painted) so as to reflect light well. In some cases baffle component 135 is highly reflective (e.g., either formed of a highly reflective material such as metal, or provided with a reflective coating). In the exemplary embodiment shown in FIG. 3, baffle 130 is a square and each baffle component 135 is identical to the other components 135, but it should be understood that this is not required. Each baffle component 135 forms one or more coupling features 145 that are configured to engage with corresponding coupling features 145 of an adjacent baffle component 135, as discussed further below. In exemplary baffle components 135, as shown in FIG. 3, coupling features 145 are tabs at one end of each component 135, and coupling features 145 are slots at the other end of each component 135, but other types of coupling features 145 are possible. Also, as few as one coupling feature, or any larger number of coupling features, may be present in each baffle component. Baffle components 135 are assembled such that front surfaces of each component face a central opening 131, an aperture through which luminaire 100 will emit light, generally in the direction of optical axis 125. Light from the light source of luminaire 100 will pass unobstructed through central opening 131, and exit the luminaire below the bottom surfaces of baffle 130.

Front surfaces of baffle components 135 desirably form ridges 142 that scatter light while reducing glare. As can be determined from FIG. 3, if light emits in various directions from a light source slightly above, even with, or below the top surfaces of baffle 130, a portion of that light may interact with ridges 142, while another portion of that light will pass unobstructed through baffle 130, and exit baffle 130 through the bottom surfaces. Ridges 142 may be contoured in various ways to promote light scattering in preferred directions. For example, in cross-section, ridges 142 may be simple curved shapes, angular sawtooth shapes, rectangular protrusions, or others, and any such shapes may form features such as flat or curved surface sections at the crest of each ridge (the place on the ridge that is furthest from the back surface) that may be shaped to scatter light in particular directions. In certain embodiments, ridges 142 are deep enough that they form re-entrant shapes along a direction of optical axis 125. A "re-entrant shape" is defined herein as one that forms features that curve in and out of a given direction such that a mold could not release in that direction from those particular features. (For example, looking ahead to FIGS. 5A and 5B, mold piece 210 cannot release downwardly (or upwardly) from baffle component 135 because mold piece 210 will run into ridges 142 in that direction). Referring back to FIG. 3, in the illustrated embodiment, ridges 142 are substantially parallel with top and bottom surfaces of each baffle component 135 ("substantially parallel" meaning that their crests and troughs are parallel with the noted surfaces as designed, subject to normal manufacturing tolerances, not arranged in diagonal or spiral fashion). Upon reading and comprehending the present disclosure, one of ordinary skill in the art will readily conceive many variations, equivalents, extensions, and alternatives to the specifically disclosed ridge layouts and contours, all of which are within the scope of embodiments herein.

Central opening 131 may be constant in cross-section—that is, components 135 may meet in such a way that the front surfaces of components 135 are vertical—but central opening typically expands, that is, central opening 131 is typically smaller at an upper end of baffle 130, and wider at a lower end of baffle 130, as shown in FIGS. 2A, 2B, 2C and 3. In embodiments where central opening 131 expands, the corresponding components 135 thus meet such that their uppermost edges are closer to optical axis 125, and their lowermost edges are further apart than the uppermost edges.

Figure 4A:
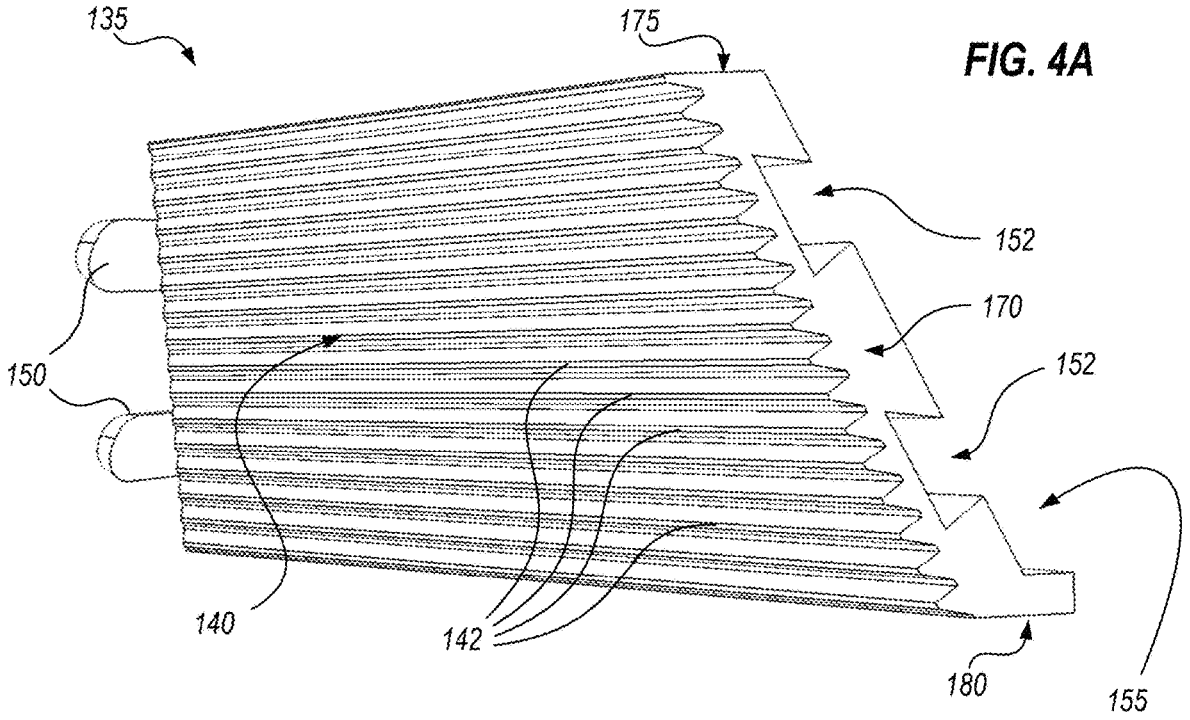
FIG. 4A is a front side perspective view of an exemplary baffle component that forms part of the exemplary baffle shown in FIGS. 2A through 2C, in accord with one or more embodiments.
Figure 4B:
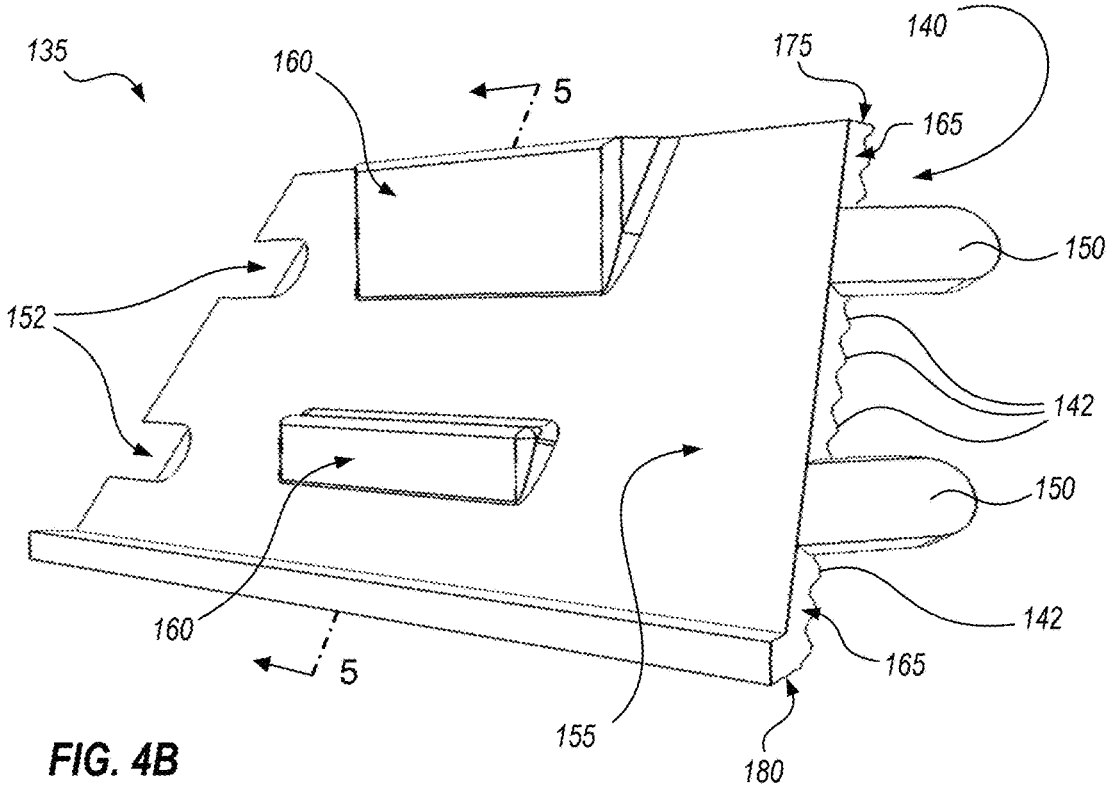
FIG. 4B is a back side perspective view of the exemplary baffle component shown in FIG. 4A.

FIG. 4A is a front side perspective view, and FIG. 4B is a back side perspective view, of exemplary baffle component 135. FIG. 4A illustrates ends of tabs 150, which extend from a first end surface 165 of component 135 (see FIG. 4B). First end surface 165 and a second end surface 170 of component 135 extend from front surface 140 to back surface 155, and from a top surface 175 to a bottom surface 180, of component 135. Each of top surface 175 and bottom surface 180, extend from front surface 140 to back surface 155, as shown. Top surface 175 and bottom surface 180 are horizontal (e.g., orthogonal to optical axis 125, FIG. 3) and planar as illustrated in FIGS. 3 and 4A, but this is not required. FIG. 4A also illustrates ridges 142 crossing a front surface 140 of component 135; only some of ridges 142 are labeled, for clarity of illustration. As noted above, in certain embodiments ridges 142 are parallel with top surface 175 and bottom surface 180. Front surface 140 and back surface 155 (FIG. 4B) are considered the major surfaces of component 135, meaning they are the largest individual surfaces of component 135 by area.

Component 135 forms slots 152 and tabs 150 as examples of coupling features 145, as discussed in connection with FIG. 3. Slots 152 are configured to receive tabs 150, and extend within back surface 155 of component 135, mostly out of sight in FIG. 4A, but ends of slots 152 are visible where they intersect a second end surface 170 of component 135. Tabs 150 and slots 152 are examples of coupling features 145, as discussed in connection with FIG. 3. Slots 152 and tabs 150 are shown as trapezoidal in shape in FIGS. 4A and 4B, but this is not required. Slots 152 and tabs 150, or any other type of coupling features 145, may be of any shape that can be molded, as described below. In the exemplary embodiment shown, first and second end surfaces 165 and 170 are angled with respect to front and back surfaces 140 and 155 respectively, so that when tabs 150 of one baffle component engage slots 152 of an adjacent baffle component 135, end surfaces 165 and 170 contact one another in face-to-face relation (e.g., see FIG. 2C and FIG. 3). In this way, when four components 135 are assembled as baffle 130, the complete baffle 130 may appear as if it were a single piece. However, this is not required; that is, end surfaces of baffle components herein may be shaped in other ways that provide a visually attractive fit between baffle components. For example, edges of front surface 140 may be curved inward (e.g., so that front surface 140 is concave) such that adjacent components do not meet at an angle, but along a curved line, and the inner surface of finished baffle 130 can be a square with rounded inside corners. The same can be done with back surface 155, if desired, so that the outside of finished baffle 130 has rounded outside corners, and the same techniques can be applied to baffle components for non-square baffles (see FIGS. 6A-6D).

FIG. 4B illustrates tabs 150 extending from first end surface 165 of component 135; ridges 142 are also shown where they intersect first end surface 165. Also visible in FIG. 4B are optional protrusions 160 from back surface 155 of component 135. Optional protrusions 160 may be configured in some embodiments to couple with features of housing 110 (see FIGS. 2A-2C) to mechanically retain baffle 130 within housing 110, but this is not required. Similarly, optional protrusions 160 may or may not be present on all baffle components 135 used to form a baffle 130. For this reason, recitations herein of baffle components that are "substantially similar" to one another specifically include cases in which some baffle components have such protrusions 160, while others do not. A line 5-5 that passes through top surface 175 and bottom surface 180 of component 135 indicates the location of a cross-sectional view that is illustrated in FIG. 5.

By comparing FIGS. 4A and 4B with FIG. 2C and FIG. 3, it can be seen that front surfaces 140 abut one another when baffle 130 is assembled, with ridges 142 extending inward therefrom, toward central opening 131 of assembled baffle 130 (FIG. 3). End surfaces 165 and 170 are configured to intersect back surface 155 at 45 degree angles (see FIGS. 2A-2C) but this angle can be adjusted. Care may be taken to match the angles of end surfaces 165 and 170 so that end surfaces 165 and 170 abut when baffled components 135 are assembled, and so that the intersections of ridges 142 on adjacent components 135 match, for an aesthetically clean look.

Baffle component 135 is advantageously made of a moldable plastic, for low cost. Suitable plastics include polycarbonate and acrylics. Advantageous materials are low in cost, moldable, opaque, dimensionally stable, not brittle (for reasons discussed below) and color stable, e.g., resistant to yellowing or other discoloration over time. Certain applications may benefit from materials that are resistant to high or low temperatures, or certain chemicals (e.g., chemical vapors that may be found in a factory or the like). Baffle component 135 may be used as molded, or may have surface treatments or coatings, for example paint or any treatment to produce a desired color or finish. However, such treatments or coatings are optional.

Figure 5A:
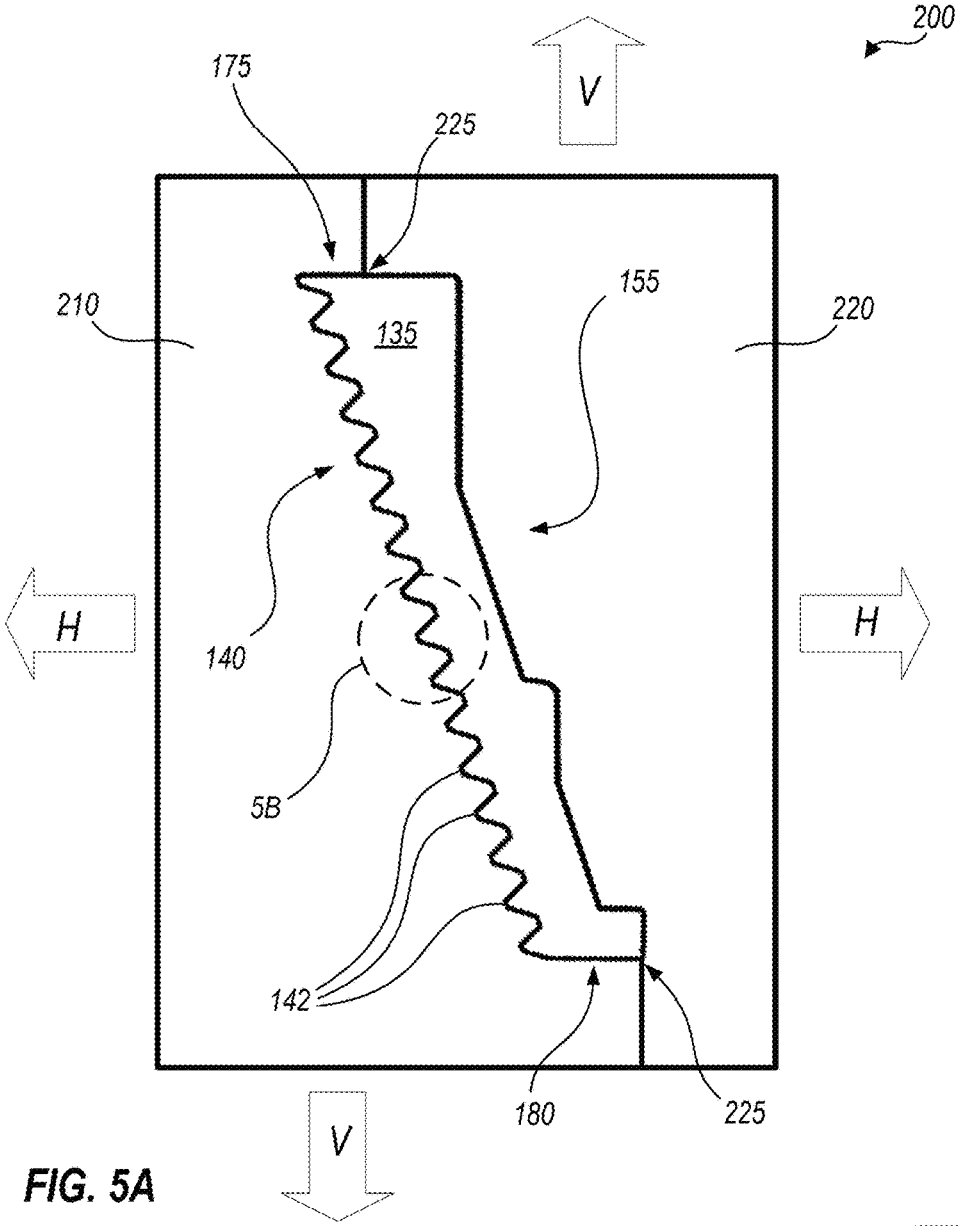
FIG. 5A is a schematic cross-sectional illustration of a two piece mold used to form the baffle component shown in FIGS. 4A and 4B, in accord with one or more embodiments.

FIG. 5A is a schematic cross-sectional illustration of a two piece mold 200 used to form baffle component 135, taken along line 5-5 shown in FIG. 4B. FIG. 5A illustrates how the shape of baffle component 135 solves the problem of molding components for a square baffle. Mold 200 includes a first mold piece 210 that forms front surface 140 of component 135, and a second mold piece 220 that forms back surface 155 of component 135, respectively. Mold pieces 210 and 220 meet at a parting line 225 that extends about component 135, in and out of the plane of FIG. 5A, above top surface 175 and below bottom surface 180 of component 135, as shown. The locations of parting line 225 on each side may advantageously be chosen so as to minimize visual appearance of the parting line on baffle component 135 within a finished luminaire. For example, in the embodiment shown, parting line 225 is positioned at the rear corner of bottom surface 180 of baffle component 135, where it will abut, or be covered by, trim ring 120 of luminaire 100 (see FIGS. 2A, 2C). The parting line within top surface 175 will not be visible within luminaire 100 because it will be viewed from below. It will also be understood by one skilled in the art that designing top surface 175 and bottom surface 180 as flat surfaces may be advantageous because such surfaces will not interfere with release from mold pieces 210, 220 and provide freedom in placement of parting lines 225. (If either top or bottom surface were concave, it would form a re-entrant feature; if either were convex, parting line 225 would have to be arranged at the highest point of top surface 175 and the lowest point of bottom surface 180.) A detail portion 5B where first mold piece 210 abuts component 135 is shown at a larger scale in FIG. 5B.

Figure 5B:
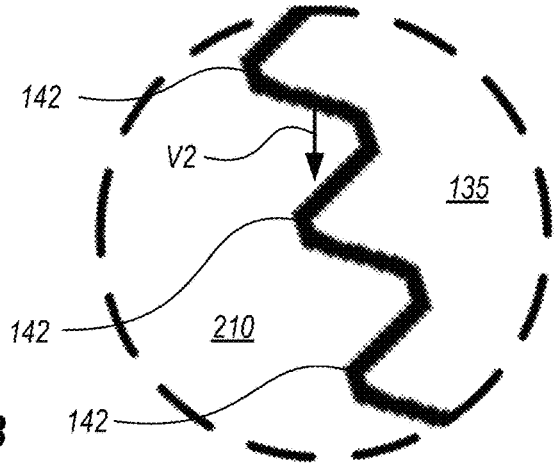
FIG. 5B is a schematic, detail view of a region noted in FIG. 5A.

When component 135 is molded, material is injected into the space between mold pieces 210 and 220, the material hardens, and mold pieces 210 and/or 220 are withdrawn from one another along the directions marked H (horizontal, as shown in FIG. 5, although molding need not be performed in that orientation). One skilled in the art can see that component 135 will release from mold 200 when mold pieces 210 and/or 220 are moved in directions H, that is, no part of component 135 forms a re-entrant shape that would interfere with movement of either mold piece in directions H. This removes constraints on the ridge design such as direction of the ridges, since mold pieces 210 and 220 can be removed with simple horizontal movements, instead of an unscrewing motion required for circular baffles with spiral shaped ridges. That is, ridges 142 can be parallel with top surface 175 and bottom surface 180, which may enable a cleaner look in the finished product. Also, ridges 142 can be deep enough that they would form re-entrant shapes in direction V, as shown in FIG. 5B. Direction V corresponds to a direction of optical axis 125, FIG. 3, where deep ridges are desirable.

FIG. 5B is a schematic, detail view of portion 5B noted in FIG. 5A. As noted above, a "re-entrant shape" is defined herein as one that forms features that curve in and out of a given direction such that a mold could not release in that direction from those particular features. For example, in FIG. 5B, mold piece 210 forms baffle component 135 with ridges that preclude mold piece 210 from being withdrawn in direction V noted in FIG. 5A. Several ridges 142 are labeled in FIG. 5B, and an arrow V2 is drawn from a point on a downwardly-facing face of one ridge 142. Arrow V2 is stopped by the upwardly-facing face of an adjacent ridge 142. This is where the adjacent ridge 142 will mechanically interfere with withdrawal of mold piece 210 in the V direction. Because the presence of the mold is required to form a downwardly-facing face, the presence of any place where a line drawn downward from such a face would encounter another part of the molded shape represents a re-entrant shape—and thus a molding impossibility, if the mold must be withdrawn in that particular direction.

FIGS. 5A and 5B thus demonstrate how component 135 solves the problem of molding a baffle of a rectilinear outline, with desirable ridges. Referring back to FIG. 3, if baffle 130 were a monolithic component with desirable ridges on all inner surfaces thereof, a mold for such component would have to have top and bottom pieces, with the top piece forming the outer surfaces (e.g., corresponding with four back surfaces 155, FIGS. 4A, 4B) and the bottom piece forming the ridges. However, if the ridges are formed with a desirable depth and contour, they would not be removable from the bottom mold piece due to the re-entrant shapes that would exist in direction V (FIG. 5) or along optical axis 125 (FIG. 3).

It will be apparent to one skilled in the art that when top surface 175 and bottom surface 180 are planar and horizontal surfaces, as shown, the location where mold pieces 210 and 220 meet may be anywhere along such surfaces. If top surface 175 and/or bottom surface 180 form variations in height, mold pieces 210 may be arranged so that parting line 225 is formed along an uppermost region of top surface 175 and along a bottommost region of bottom surface 180. Also, slots 152 can be formed by using pins inserted into prearranged locations in one mold piece or the other (usually mold piece 220 that forms the features corresponding to back surface 155). As is known in molding, the pins can be inserted before molding, then removed from the molded component 135 before it is separated from the appropriate mold piece, allowing component 135 to separate easily from both mold pieces. Alternatively, slots 152 can be machined into components 135 after molding is complete.

When four baffle components 135 are assembled to form a complete baffle 130 (e.g., FIG. 3) it may be necessary to bend tabs 150 slightly. This is because when three baffle components 135 are assembled together, the three components will interfere with a position of the fourth component that would be needed for tabs 150 to slide into slots 152. In practice, an assembler may bend the three assembled baffle components 135 slightly, away from one another, to allow positioning of the fourth baffle component 135 so that its tabs 150 can enter slots 152 of an adjacent component 135, and vice versa. It is because of this that the material of components 135 should be slightly flexible, and not brittle.

Figure 6A:
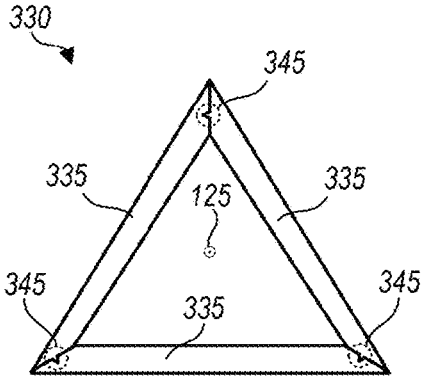
FIG. 6A schematically illustrates a triangular baffle that is formed of three baffle components, in accord with one or more embodiments.

FIGS. 6A, 6B, 6C and 6D schematically illustrate how the principles taught above with respect to a square baffle can be used to manufacture baffle components that can be assembled to form baffles of other geometries. FIG. 6A schematically illustrates a triangular baffle 330 that is formed of three baffle components 335, each pair of which are coupled at coupling features 345. Baffle 330 is centered about optical axis 125, which extends in and out of the plane of each of FIGS. 6A, 6B, 6C and 6D. Baffle components 335 are shown schematically in that slopes of the components along a direction of optical axis 125, and/or optional features that may be present on front or back surfaces of components 335, are omitted for clarity of illustration. In FIG. 6A, numeral 345 denotes the coupling features of both adjacent components 335. The shape of coupling features 345 does not indicate their physical shapes, but rather their complementarity, in which the coupling feature 345 at one end of a component 335 will engage the coupling feature 345 at the other end of an adjacent component 335. Baffle components 435, 535 and 635, and their coupling features 445, 545 and 645 discussed below, are similarly not illustrated to indicate physical shapes, but rather to show their arrangements and complementarity.

In FIG. 6A, end surfaces of components 335 are provided with thirty degree angles relative to their back surfaces (measured in what would typically be a horizontal plane in use, orthogonal to optical axis 125). These angles enable substantially face-to-face contact when engaged, for a clean aesthetic look.

Figure 6B:
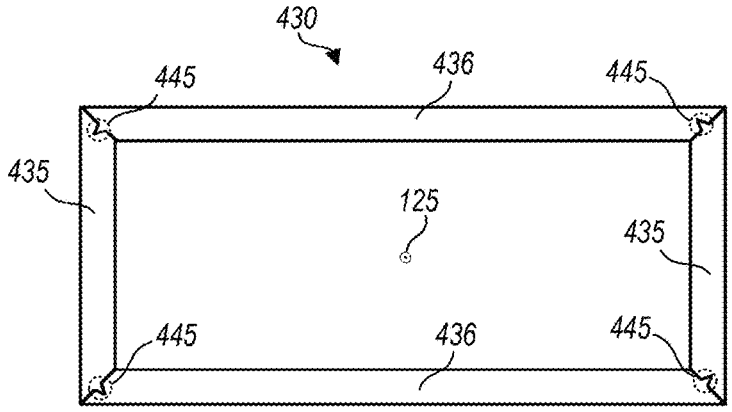
FIG. 6B schematically illustrates a rectangular baffle that is formed of two first baffle components, and two second baffle components that are longer than the first baffle components, in accord with one or more embodiments.

FIG. 6B schematically illustrates a (non-square) rectangular baffle 430 that is formed of two baffle components 435, and two baffle components 436 that are longer than baffle components 435. End surfaces of components 435 are provided with forty-five degree angles relative to their back surfaces, measured orthogonal to optical axis 125, to enable substantially face-to-face contact when engaged. By using complementary coupling features 445 for both baffle components 435 and 436, it is possible to combine them in the pairs shown to create rectangular baffle 430. Or, for manufacturing flexibility, it would be possible to combine four of baffle components 435 to form a square baffle of one size, or four of baffle components 436 to form a square baffle of a larger size. Upon reading and comprehending the present disclosure, one of ordinary skill in the art will readily conceive many equivalents, extensions, and alternatives. For this reason, references herein to baffle components that are "substantially similar" to one another also specifically include cases in which some baffle components have different lengths from one another, as well as including optional features (such as, for example, protrusions 160, FIG. 4B) or variations of the optional features, as long as other recited features are present.

Figure 6C:
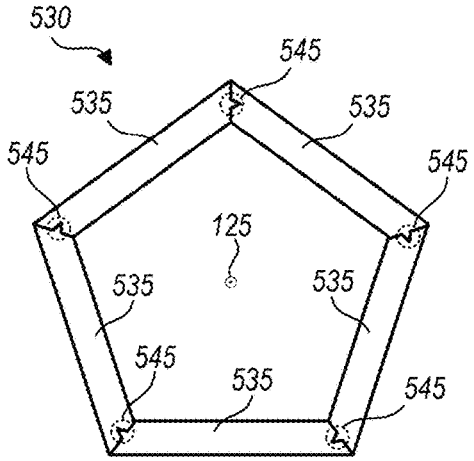
FIG. 6C schematically illustrates a pentagonal baffle that is formed of five baffle components, in accord with one or more embodiments.
Figure 6D:
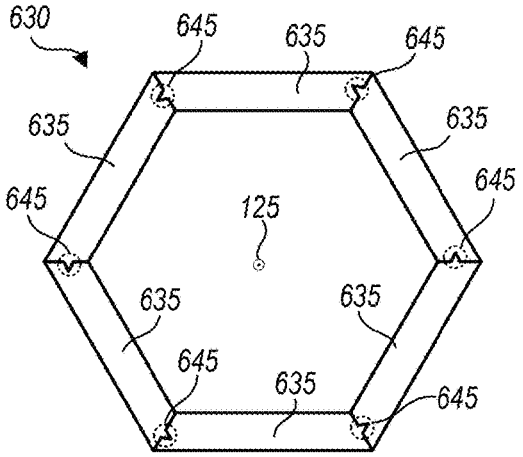
FIG. 6D schematically illustrates a hexagonal baffle that is formed of six baffle components, in accord with one or more embodiments.

FIG. 6C schematically illustrates a pentagonal baffle 530 that is formed of five baffle components 535 that couple with coupling features 545. End surfaces of components 535 are provided with fifty-four degree angles relative to their back surfaces, measured orthogonal to optical axis 125, to enable substantially face-to-face contact when engaged. FIG. 6D schematically illustrates a hexagonal baffle 630 that is formed of six baffle components 635 that couple with coupling features 645. End surfaces of components 635 are provided with sixty degree angles relative to their back surfaces, measured orthogonal to optical axis 125, to enable substantially face-to-face contact when engaged. Like baffle 430, FIG. 6B, identical baffle components 635 can be coupled with one another to form the hexagonal shape shown. In other embodiments, combinations of similar baffle components having the same end surface angles and coupling features, but differing lengths, can form baffles that have similar shapes but are longer or shorter on two opposing sides. In still other embodiments, two or more baffle components can be combined into a single, moldable baffle component with multiple sides, as long as the sides do not form a re-entrant shape that would be impossible to mold. Doing so can advantageously reduce the number of molded components that must be assembled to form a complete baffle. Upon reading and comprehending the present disclosure, one of ordinary skill in the art will readily conceive many variations, equivalents, extensions, and alternatives to the specifically disclosed baffle components, all of which are within the scope of embodiments herein.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described, are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A baffle component for a luminaire, the baffle component comprising a portion of opaque material that forms:

a generally planar body having a front surface and a back surface as major surfaces, the front surface comprising a plurality of ridges;

a top surface and a bottom surface that each extend from the front surface to the back surface; and a first end surface and a second end surface, that each extend from the front surface to the back surface, and from the top surface to the bottom surface;

and wherein:

the back surface is longer than the front surface such that the first end surface and the second end surface are angled with respect to the front surface and the back surface and such that the first end surface and the second end surface are not parallel to one another;

the first end surface comprises a first coupling feature, and the second end surface comprises a second coupling feature that is configured to engage the first coupling feature of a second baffle component that is substantially identical to the baffle component; and each of the plurality of ridges forms a re-entrant shape along a direction that is orthogonal to the top and bottom surfaces such that a crest of a lower ridge of each adjacent pair of the plurality of ridges protrudes laterally beyond a trough of a higher ridge of the respective adjacent pair of the plurality of ridges.

2. The baffle component of claim 1, wherein the ridges are substantially parallel with the top surface or the bottom surface.

3. The baffle component of claim 1, wherein the first and second end surfaces are angled, such that when the second coupling feature engages the first coupling feature of the second baffle component, the first end surface contacts the second end surface of the second baffle component in face-to-face relation.

4. The baffle component of claim 1, wherein the top surface and the bottom surface are substantially planar and parallel with one another.

5. The baffle component of claim 4, wherein the first and second end surfaces are angled at forty-five degrees relative to the front surface and the back surface, measured in a plane parallel with the top and bottom surfaces.

6. The baffle component of claim 1, wherein the first coupling feature comprises one or more tabs, and the second coupling feature comprises one or more slots configured to receive the tabs.

7. The baffle component of claim 6, wherein the first coupling feature consists of two tabs, and the second coupling feature consists of two slots configured to receive corresponding ones of the two tabs.

8. The baffle component of claim 1, wherein the back surface forms one or more protrusions for engagement with a luminaire housing.

9. A baffle for a luminaire, the baffle comprising a plurality of substantially similar baffle components, wherein each baffle component comprises a portion of opaque material that forms:

a generally planar body having a front surface and a back surface as major surfaces, the front surface comprising a plurality of ridges;

a top surface and a bottom surface that each extend from the front surface to the back surface;

a first end surface and a second end surface, that each extend from the front surface to the back surface, and from the top surface to the bottom surface; and the first end surface comprises a first coupling feature, and the second end surface comprises a second coupling feature that is configured to engage the first coupling feature of another one of the plurality of baffle components;

wherein:

the back surface is longer than the front surface such that the first end surface and the second end surface are angled with respect to the front surface and the back surface;

each of the plurality of ridges forms a re-entrant shape along a direction that is orthogonal to the top and bottom surfaces such that a crest of a lower ridge of each adjacent pair of the plurality of ridges protrudes laterally beyond a trough of a higher ridge of the respective adjacent pair of the plurality of ridges;

the plurality of the baffle components engage with one another, with the first coupling feature of each of the baffle components engaging with the second coupling feature of another of the baffle components, to form a shape that surrounds a central opening of the luminaire, an optical axis being defined as a centerline of the central opening;

when the plurality of baffle components are engaged with one another, the first end surface of a first baffle component contacts the second end surface of a second baffle component in a face-to-face relation; and the front surfaces face the central opening and the optical axis;

such that at least a portion of light emitted into the central opening can pass unobstructed from any point within or above the baffle, through the central opening, and can exit below the bottom surfaces.

10. The baffle of claim 9, wherein the central opening comprises a constant cross-section along the optical axis.

11. The baffle of claim 9, wherein the central opening comprises a cross-section that increases in width along the optical axis.

12. The baffle component of claim 9, wherein the ridges are substantially parallel with both the top and bottom surfaces.

13. The baffle of claim 9, wherein the plurality of baffle components consists of four of the baffle components, and the first and second end surfaces of each baffle component are angled at forty-five degree angles in a plane that is orthogonal to the optical axis.

14. The baffle of claim 9, wherein the top surfaces of the plurality of baffle components are of equal width, from their respective first end surfaces to their respective second end surfaces, so that the central opening forms a square cross-section.

15. The baffle of claim 9, wherein the top surfaces of a first pair of the plurality of baffle components that face one another across the central opening, each form a first width from their respective first end surfaces to their respective second end surfaces, and the top surfaces of a second pair of the plurality of baffle components that face one another across the central opening, each form a second width from their respective first end surfaces to their respective second end surfaces, the second width being greater than the first width, so that the central opening forms a non-square, rectangular cross-section.

16. The baffle of claim 9, wherein one or more of the baffle components form protrusions for mechanical engagement with a housing.

* * * * *